US007162983B1

(12) United States Patent
Raghavan et al.

(10) Patent No.: US 7,162,983 B1
(45) Date of Patent: Jan. 16, 2007

(54) VALVE ACTUATOR ASSEMBLY FOR VARIABLE DISPLACEMENT OF AN ENGINE VALVE

(75) Inventors: Madhusudan Raghavan, West Bloomfield, MI (US); Mark A. Kramarczyk, Sterling Heights, MI (US)

(73) Assignee: GM Global Technology OPerations, Inc., Detroit, MI (US)

( * ) Notice: Subject to any disclaimer, the term of this patent is extended or adjusted under 35 U.S.C. 154(b) by 0 days.

(21) Appl. No.: 11/360,028

(22) Filed: Feb. 22, 2006

(51) Int. Cl.
*F01L 1/34* (2006.01)

(52) U.S. Cl. ..... 123/90.16; 123/90.39; 123/90.44; 74/569

(58) Field of Classification Search ..... 123/90.16, 123/90.2, 90.34, 90.36, 90.39, 90.44; 74/559, 74/567, 569
See application file for complete search history.

(56) References Cited

U.S. PATENT DOCUMENTS

| | | | | |
|---|---|---|---|---|
| 4,459,946 A | 7/1984 | Burandt | ..... | 123/90.16 |
| 4,970,997 A | 11/1990 | Inoue et al. | ..... | 123/90.16 |
| 5,373,818 A | 12/1994 | Unger | ..... | 123/90.16 |
| 5,529,033 A | 6/1996 | Hampton | ..... | 123/90.16 |
| 5,655,488 A | 8/1997 | Hampton et al. | ..... | 123/90.16 |
| 6,112,711 A | 9/2000 | Shimizu et al. | ..... | 123/90.16 |
| 6,550,435 B1 * | 4/2003 | Zubeck | ..... | 123/90.16 |
| 6,691,657 B1 | 2/2004 | Hendriksma et al. | .... | 123/90.39 |
| 6,948,466 B1 | 9/2005 | Haas et al. | ..... | 123/90.16 |

* cited by examiner

*Primary Examiner*—Ching Chang
(74) *Attorney, Agent, or Firm*—Kathryn A. Marra

(57) ABSTRACT

An engine valve actuator assembly is provided that includes a movable roller finger follower operatively engaged with a displaceable engine valve. A rotatable camshaft with a plurality of different cam lobes having different profiles rotates about the roller finger follower. A plurality of intermediate finger followers contact different ones of the cam lobes and pivot about a common axis. One of the intermediate finger followers is in continuous contact with the roller finger follower. One or more additional intermediate finger followers are separately selectively engageable for common pivoting with the intermediate finger follower that remains in continuous contact with the roller finger follower, thereby varying displacement of the engine valve depending upon the various cam profiles.

15 Claims, 2 Drawing Sheets

VALVE ACTUATOR ASSEMBLY FOR VARIABLE DISPLACEMENT OF AN ENGINE VALVE

TECHNICAL FIELD

The present invention relates to an engine valve actuator assembly for variable valve lift and cylinder deactivation for an engine.

BACKGROUND OF THE INVENTION

Engine valve actuator assemblies for an engine such as an internal combustion engine on a motor vehicle typically require a two-piece roller finger follower connected with the engine valve and pivotable in response to cam motion to lift the valve. A two-piece roller finger follower presents significant design, control and durability challenges. The two-pieces are not necessarily in continuous contact with one another; therefore, noise control measures may be required to prevent noise from occurring when the two pieces of the roller finger follower separate from one another. There are also significant side forces that act upon the two pieces of the roller finger follower, thus requiring significant component strength of each piece.

SUMMARY OF THE INVENTION

An engine valve actuator assembly is provided that achieves variable valve displacement (i.e., lift) and/or valve deactivation (i.e., keeping the valve closed) while maintaining components of the assembly in continuous contact with one another to prevent unwanted noise. The assembly utilizes a conventional engine valve and roller finger follower so that minimal change to the valve head is required.

Specifically an engine valve actuator assembly is provided that includes a movable engine valve and a movable roller finger follower that is continuously operatively engaged with the engine valve. A rotatable camshaft is provided with a plurality of cam lobes having different profiles, including at least a first and a second cam lobe axially displaced from one another. The first cam lobe is of a first profile and the second cam lobe is of a second profile larger than the first profile. A plurality of intermediate finger followers are each contactable with a different one of the cam lobes and are pivotable about a common axis. One of the intermediate finger followers is in continuous contact with the roller finger follower and is contactable with the first cam lobe having the first (smallest) profile. The second intermediate finger follower may be selectively engaged for common pivoting with the first intermediate finger follower to vary displacement of the engine valve. The larger profile of the second cam lobe will dominate when the first and second intermediate finger followers are engaged for common pivoting, thus causing a greater displacement of the engine valve. Optionally, a third intermediate finger follower may be positioned such that it is contactable with a third cam lobe having a third profile larger than the first profile but smaller than the second profile. The third intermediate finger follower may be selectively engaged for common pivoting with the first intermediate finger follower, thereby causing a third level of displacement because the larger third cam profile will dominate over any displacement otherwise caused by the first cam profile. Pins may be used for selectively engaging or locking the respective intermediate finger followers to the first intermediate finger follower. The pins may be hydraulically or electrically actuated.

Preferably, springs urge the intermediate finger followers into contact with the respective cam lobes to maintain smooth and continuous engagement of the components.

Optionally, a camshaft phaser may be operatively connected to the camshaft to selectively modify phasing or timing of engine valve opening and closing.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
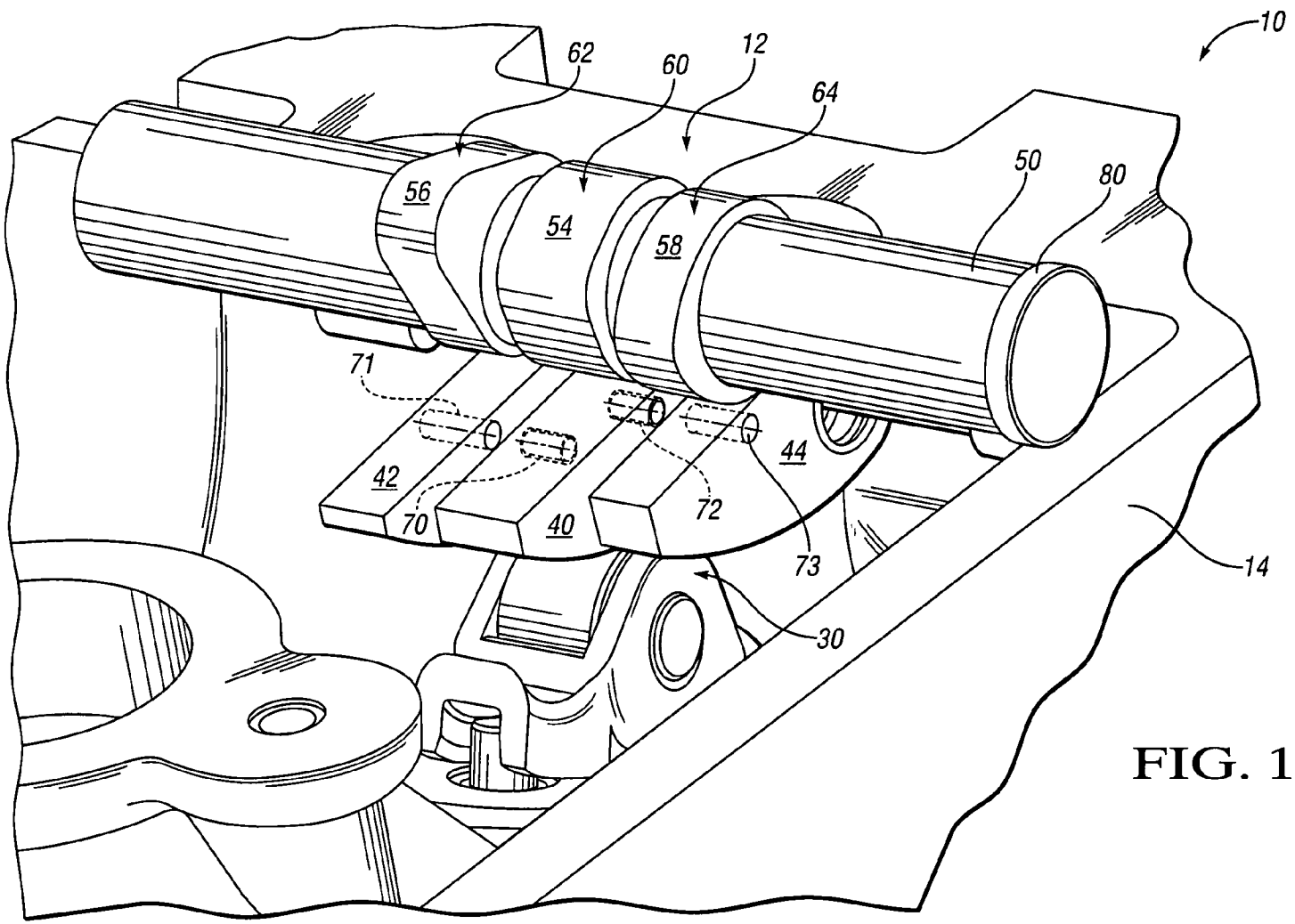
FIG. 1 is a schematic perspective illustration of an engine having an engine valve actuator assembly within the scope of the invention.

Referring to the drawings, wherein like reference numbers refer to like components, in FIG. 1, one embodiment of an engine 10 equipped with an engine valve actuator assembly 12 is depicted. The engine 10 includes an engine block 14. As may be better viewed in FIG. 2, engine block 14 has at least one opening 16 that is in communication with an internal combustion chamber. The combustion chamber is not shown, but is understood by those skilled in the art.

Figure 2:
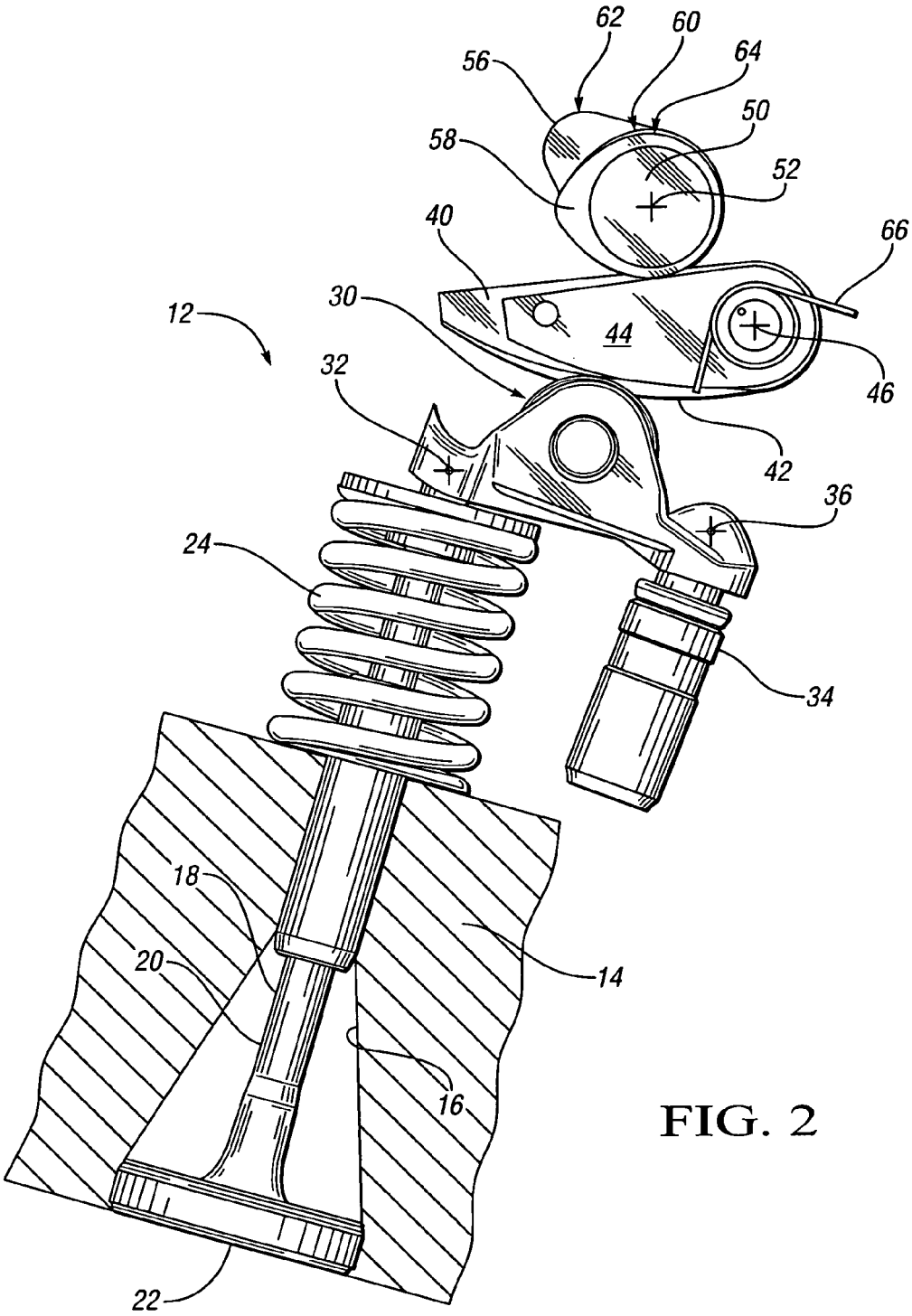
FIG. 2 is a schematic side illustration in partial cross-sectional view of the engine valve actuator assembly of FIG. 1 positioned in an engine block of the engine of FIG. 1.

The engine valve actuator assembly 12 includes a movable engine valve 18 for each opening 16. The valve 18 has a valve stem 20 with a valve head 22 at one end of the valve stem 20. The valve head 22 is sized to close the opening 16 when the valve 18 is closed. An engine valve spring 24 is disposed about the valve stem 20 in contact with the engine block 14 to bias to engine valve 18 toward a closed position as shown in FIG. 2. The valve opening 16 can also be referred to as a valve port.

The engine valve actuator assembly 12 includes a roller finger follower 30 that pivots to control the position of the engine valve 18. Roller finger follower 30 has one end in contact with one end of the valve stem 20 opposite the valve head 22 at a contact point 32. The engine valve actuator assembly 12 also includes a hydraulic lash adjuster 34 adjacent the other end of the roller finger follower 30. The lash adjuster 34 is pivotally connected to the other end of the roller finger follower 30 at an attachment point 36, preferably, with a ball and socket type connector, as is known in the art. It should be appreciated that the attachment point 36 is a pivot point for the roller finger follower 30.

The engine valve actuator assembly 12 also includes first, second and third axially-spaced intermediate finger followers, 40, 42 and 44, respectively. As may be better viewed in FIG. 2, the intermediate finger followers 40, 42 and 44 are each pivotable about a pivot axis running through point 46. Unless pinned together as described below, the intermediate finger followers 40, 42 and 44 independently pivot about the pivot axis through point 46 in response to rotation of camshaft 50 spaced thereabove. Camshaft 50 is and rotatable about an axis through point 52.

More specifically, the camshaft 50 is formed with three different cam lobes. The first cam lobe 54 is centrally located and may be in contact with the first intermediate finger follower 40 if neither of intermediate finger followers 42 and 44 are pinned to intermediate finger follower 40. The first intermediate finger follower 40 is in continuous connect with the roller finger follower 30 as described below. The second and third intermediate finger followers 42, 44, are axially spaced from the first intermediate finger follower 40 and are not in direct in physical contact with the roller finger follower 30. A second cam lobe 56 is positioned above the second intermediate finger follower 42 to cause pivoting movement thereof when the camshaft 50 rotates. A third cam lobe 58 is positioned above the third intermediate finger follower 44 to cause pivoting movement thereof when the camshaft 50 rotates. The first cam lobe 54 has a first cam profile 60 which is partially visible in FIG. 2 and is smaller than a second cam profile 62 of the second cam lobe 56. The third cam lobe 58 has a third cam profile 64 that is larger than the first cam profile 60 but smaller than the second cam profile 62. Accordingly, when the cam shaft 50 rotates, the first intermediate finger follower 40 will pivot the least amount, the second intermediate finger follower 42 will pivot the greatest amount and the third intermediate finger follower 44 will pivot an amount between that of the first intermediate finger follower 40 and the second intermediate finger follower 42, assuming that none of the intermediate finger followers are pinned or otherwise engaged with one another for common pivoting. When neither of the second and third intermediate finger followers 42 and 44 are engaged with the first finger follower 40 for common pivoting, only the pivoting action of the first intermediate finger follower 40 affects the movement of the roller finger follower 30 and thus the valve stem 18 to cause a first displacement of the engine valve 20. The amount of the first displacement may be zero, i.e., the engine valve 20 may remain in the closed position absent any engagement of the second or third intermediate finger followers 42, 44 with the first intermediate finger follower 40. Alternatively, the amount of the first displacement may be positive. The first cam profile 60 governs the amount of first displacement. If the first displacement is zero, the engine valve remains closed, or deactivated. Optional deactivation of engine cylinders, or displacement on demand, may be desirable when the engine 10 is an internal combustion engine used with a conventional transmission and less torque is required, for example, during cruising. Cylinder deactivation may also be applied to an engine used in conjunction with an electrically variable transmission when engine power contribution is not desired under existing vehicle operating conditions.

A spring 66, which is a torsion spring centered around the pivot axis that extends through point 46, biases the intermediate finger follower 44 into contact with cam lobe 58. Two additional springs (not shown) may be placed between the first and second intermediate finger followers 40, 42 and the first and third intermediate finger followers 40, 44, respectively, for biasing intermediate finger followers 40 and 42 into contact with respective cam lobes 56 and 54.

To vary displacement of the engine valve 20, a pin 70 may be actuated to move from a first position in which it is supported within the first intermediate finger follower 40, to a second position in which it extends within a recess 71 in the second intermediate finger follower 42 to lock the second intermediate finger follower 42 and first intermediate finger follower 40 together for common pivoting (i.e., to pivot a same amount of rotational displacement) about the pivot axis through point 46. Thus, with the first and second intermediate finger followers 40, 42 locked together, the second cam 56, with its larger second cam profile 62, will cause both the first and second intermediate finger followers 40, 42 to pivot an amount determined by the second cam profile 62. Thus, the roller finger follower 30 in continuous connect with the first intermediate finger follower 40 will cause the valve stem 18 and thus the engine valve 20 to displace a second amount of displacement greater than the first displacement, moving valve head 22 further away from opening 16 and thus allowing greater flow into the combustion chamber. The pin 70 may be hydraulically or electrically actuated in response to a control signal received from an electronic control unit as described below and as is understood by those skilled in the art.

Alternatively, if a third amount of displacement is desired, a second actuator pin 72 may be moved to extend from a first position in which it is supported within the first intermediate finger follower 40 to an extended position in which it extends into a recess 73 in the third intermediate finger follower 44 and locks the first and third intermediate finger followers 40, 44 together for common pivoting about the pivot axis through point 46. Thus, third cam profile 64 of third cam 58 will dominate and cause greater pivoting of the first intermediate finger follower 40 via the engagement with the third intermediate finger follower 44 to cause a third amount of displacement of the engine valve 20. Like the pin 70, pin 72 may be hydraulically or electrically actuated. It should be appreciated that pins 70, 72 may alternatively be supported in the second and third intermediate finger followers 42, 44, respectively and actuate into recesses formed in the first intermediate finger follower 40. In either case, the pins and corresponding recesses may be located anywhere on the intermediate finger followers. Finally, it should also be appreciated that recesses may not be required if the pins are of a sufficient size and impart a sufficient tangential force upon the respective adjacent intermediate finger followers to affect common pivoting.

Optionally, a camshaft phaser 80 may be operatively connected to the camshaft 50 to vary phasing of the engine valve 20 (i.e., vary the opening and closing of the engine valve 20 as caused by rotation of the camshaft 50 in relation to a rotational position of an engine crankshaft (not shown) as is understood by those skilled in the art).

Those skilled in the art will understand that the pins 70 and 72 as well as the camshaft phaser 80 are controlled via an electronic control unit (not shown) which selects optimal valve lift and phasing dependent upon a variety of selected engine operating conditions according to an algorithm stored within the control unit.

Accordingly, the engine valve actuator assembly 12 provides varying amounts of valve displacement or actuation using a conventional roller finger follower 30 and a first intermediate finger follower 40 which is always in contact with the roller finger follower 30, thereby avoiding potential noise associated with engagement and disengagement of these components. The engine valve 20 and the roller finger follower 30 are typical of those used in other designs; thus the engine valve actuator assembly 12 may be employed without expensive redesign of the engine head.

While the best modes for carrying out the invention have been described in detail, those familiar with the art to which this invention relates will recognize various alternative designs and embodiments for practicing the invention within the scope of the appended claims.

The invention claimed is:

1. A valve actuator assembly comprising:

a movable engine valve;

a movable roller finger follower continuously operatively engaged with said engine valve;

a rotatable camshaft having a first and a second cam lobe axially displaced from one another; wherein said first cam lobe is of a first profile and wherein said second cam lobe is of a second profile larger than said first profile;

a first intermediate finger follower contactable with said first cam lobe and in continuous contact with said roller finger follower;

a second intermediate finger follower in continuous contact with said second cam lobe;

wherein said intermediate finger followers are pivotable about a common axis; and wherein said second intermediate finger follower is selectively engagable with said first intermediate finger follower for common pivoting therewith; said first intermediate finger follower effecting a first displacement of said engine valve governed by said first cam lobe when said second intermediate finger follower is not engaged with said first intermediate finger follower and said second intermediate finger follower effecting a second displacement of said engine valve greater than said first displacement and governed by said second cam lobe when said second intermediate finger follower is engaged with said first intermediate finger follower.

2. The valve actuator assembly of claim 1, further comprising:

a pin selectively movable for locking said second intermediate finger follower to said first intermediate finger follower.

3. The valve actuator assembly of claim 1, wherein said camshaft has a third cam lobe axially displaced from said first cam lobe opposite said second cam lobe, said third cam lobe having a third profile larger than said first profile and less than said second profile, and further comprising:

a third intermediate finger follower contactable with said third cam lobe and pivotable about said common axis; wherein said third intermediate finger follower is selectively engagable with said first intermediate finger follower for common pivoting therewith to thereby cause a third displacement of said engine valve governed by said third cam lobe and greater than said first displacement but less than said second displacement.

4. The valve actuator assembly of claim 3, further comprising:

a pin selectively movable for locking said third intermediate finger follower to said first intermediate finger follower.

5. The valve actuator assembly of claim 1, further comprising:

at least one spring urging at least one of said intermediate finger followers into contact with said respective cam lobes.

6. The valve actuator assembly of claim 1, further comprising:

a camshaft phaser operative on the camshaft to selectively modify timing of said engine valve.

7. An engine valve actuator assembly comprising:

a displacable engine valve;

a movable roller finger follower continuously operatively engaged with said engine valve;

a rotatable camshaft having a plurality of cam lobes of different profiles;

a plurality of intermediate finger followers each contactable with a different respective one of said cam lobes and pivotable about a common axis; wherein one of said intermediate finger followers is in continuous contact with said roller finger follower; and wherein another of said intermediate finger followers is selectively engagable for common pivoting with said intermediate finger follower in continuous contact with said roller finger follower, wherein an selective engagement between the two said intermediate finger followers thereby varying displacement of said engine valve.

8. The valve actuator assembly of claim 7, wherein said intermediate finger follower in continuous contact with said roller finger follower is a first intermediate finger follower contactable with a first cam lobe of said plurality of cam lobes; and wherein said intermediate follower selectively engagable with said first intermediate finger follower is a second intermediate finger follower contactable with a second cam lobe of said plurality of cam lobes, said second cam lobe having a profile larger than a profile of said first cam lobe.

9. The valve actuator assembly of claim 8, wherein a third of said plurality of intermediate finger followers is selectively engagable with said first intermediate finger follower and is contactable with a third of said cam lobes having a profile larger than said first profile and smaller than said second profile.

10. The valve actuator assembly of claim 7, further comprising:

a pin selectively movable for locking said another of said intermediate finger follower to said intermediate finger follower in continuous contact with said roller finger follower.

11. The valve actuator assembly of claim 7, further comprising:

at least one spring urging at least one of said intermediate finger followers into contact with said respective cam lobes.

12. The valve actuator assembly of claim 7, further comprising:

a camshaft phaser operative on the camshaft to selectively modify timing of said engine valve.

13. An engine comprising:

an engine block forming a chamber;

a movable engine valve for opening and closing a valve port in communication with said chamber;

a movable roller finger follower continuously operatively engaged with said engine valve above said engine valve;

a rotatable camshaft having a first and a second cam lobe axially displaced from one another; wherein said first cam lobe is of a first profile and wherein said second cam lobe is of a second profile larger than said first profile;

a first intermediate finger follower contactable with said first cam lobe and in continuous contact with said roller finger follower;

a second intermediate finger follower in continuous contact with said second cam lobe; and wherein said intermediate finger followers are pivotable about a common axis; wherein said second intermediate finger follower is selectively engagable with said first intermediate finger follower for common pivoting therewith; said first intermediate finger follower effecting a first displacement of said engine valve governed by said first cam lobe when said second intermediate finger follower is not engaged with said first intermediate finger follower and said second intermediate finger follower effecting a second displacement of said engine valve greater than said first displacement and governed by said second cam lobe when said second intermediate finger follower is engaged with said first intermediate finger follower.

14. The engine of claim 13, further comprising:

a camshaft phaser operatively connected with said camshaft for varying a relative rotational position of said camshaft with respect to said engine valve.

15. The engine of claim 13, wherein said first intermediate finger follower is in continuous contact with said roller finger follower above said roller finger follower.

* * * * *